US011013301B2

(12) United States Patent
Yang et al.

(10) Patent No.: US 11,013,301 B2
(45) Date of Patent: May 25, 2021

(54) WATCH CLASP CAPABLE OF FINELY ADJUSTING WATCH STRAP LENGTH

(71) Applicant: HUAWEI TECHNOLOGIES CO., LTD., Guangdong (CN)

(72) Inventors: Rongguang Yang, Shenzhen (CN); Jun Liu, Shenzhen (CN); Menglong Zhao, Shenzhen (CN); Bin Zhang, Shenzhen (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/603,660

(22) PCT Filed: Apr. 24, 2017

(86) PCT No.: PCT/CN2017/081608

§ 371 (c)(1),
(2) Date: Oct. 8, 2019

(87) PCT Pub. No.: WO2018/188112

PCT Pub. Date: Oct. 18, 2018

(65) Prior Publication Data

US 2020/0113295 A1 Apr. 16, 2020

(30) Foreign Application Priority Data

Apr. 14, 2017 (CN) ..... 201710245369.2

(51) Int. Cl.
*A44C 5/24* (2006.01)
*A44C 5/04* (2006.01)

(52) U.S. Cl.
CPC ..... *A44C 5/246* (2013.01); *A44C 5/04* (2013.01); *Y10T 24/2155* (2015.01); *Y10T 24/4782* (2015.01)

(58) Field of Classification Search
CPC .. A44C 5/246; Y10T 24/2155; Y10T 24/4782
See application file for complete search history.

(56) References Cited

U.S. PATENT DOCUMENTS 2,461,309 A * 2/1949 Cedar ..... A44C 5/246 24/71 R
4,096,688 A 6/1978 Rieth
(Continued)

FOREIGN PATENT DOCUMENTS

CH 706904 A2 3/2014
CN 1168252 A 12/1997
(Continued)

OTHER PUBLICATIONS

Extended (Supplementary) European Search Report dated May 12, 2020, issued in counterpart EP Application No. 17905897.9. (6 pages).
(Continued)

*Primary Examiner* — Robert Sandy
*Assistant Examiner* — Michael S Lee
(74) *Attorney, Agent, or Firm* — Westerman, Hattori, Daniels & Adrian, LLP

(57) ABSTRACT

A watch clasp with a finely adjustable watch strap length includes: a watch clasp sliding holder, located on a back surface of a watch clasp case; a sliding stop module, fixing the watch clasp sliding holder to the back surface of the watch clasp case through engagement, where the sliding holder can slide between the watch clasp case and the sliding stop module; a stop spring bar, fixed to the watch clasp case, and an unlock module, fixed to the watch clasp case where the unlock module is engaged with the sliding stop module, and the stop spring bar and the unlock module are respectively located on two sides of the sliding stop module; and an extension latch assembly, where one end of the extension latch assembly is fixed to the watch clasp case, and another
(Continued)

end of the extension latch assembly is fixed to an elastic fine-adjusting assembly.

12 Claims, 7 Drawing Sheets

(56) References Cited

U.S. PATENT DOCUMENTS

| | | | | |
|---|---|---|---|---|
| 5,749,128 | A | 5/1998 | Cuche | |
| 6,108,821 | A * | 8/2000 | Malsoute | A44B 11/008 2/312 |
| 7,797,801 | B2 | 9/2010 | Takahashi | |
| 2004/0083581 | A1* | 5/2004 | Kawagoe | A44C 5/2052 24/265 WS |
| 2007/0271740 | A1 | 11/2007 | Yamamoto | |
| 2008/0083101 | A1* | 4/2008 | Christian | A44C 5/246 24/71 J |
| 2009/0049667 | A1* | 2/2009 | Takahashi | A44C 5/246 24/71 J |
| 2012/0312052 | A1 | 12/2012 | Yliluoma et al. | |
| 2014/0150223 | A1* | 6/2014 | Kaltenrieder | A44C 5/246 24/71 J |
| 2015/0366303 | A1 | 12/2015 | Pier | |
| 2019/0183213 | A1* | 6/2019 | Viller | A44C 5/246 |

FOREIGN PATENT DOCUMENTS

| | | | |
|---|---|---|---|
| CN | 101077241 | A | 11/2007 |
| CN | 103222711 | A | 7/2013 |
| CN | 204812406 | U | 12/2015 |
| DE | 102005005834 | A1 | 8/2006 |
| EP | 1378185 | A1 | 1/2004 |

OTHER PUBLICATIONS

Office Action dated Mar. 28, 2019, issued in counterpart CN Application No. 201780008215.X, with English translation. (11 pages).

Office Action dated Jul. 3, 2019, issued in counterpart CN Application No. 201780008215.X, with English translation. (6 pages).

International Search Report and Written Opinion dated Jan. 11, 2018, issued in counterpart Application No. PCT/CN2017/081608, with English translation. (17 pages).

* cited by examiner

WATCH CLASP CAPABLE OF FINELY ADJUSTING WATCH STRAP LENGTH

CROSS-REFERENCE TO RELATED APPLICATIONS

This application is a National Stage of International Application No. PCT/CN2017/081608, filed on Apr. 24, 2017, which claims priority to Chinese Patent Application No. 201710245369.2, filed on Apr. 14, 2017. Both of the aforementioned applications are hereby incorporated by reference in their entireties.

TECHNICAL FIELD

This application relates to a watch clasp, and in particular, to a watch clasp capable of finely adjusting a watch strap length.

BACKGROUND

Currently, a watch is adapted to a wrist size of a wearer by adjusting a length of a watch strap. However, the wrist size of the wearer changes with an environment. For example, the wrist size increases after the wearer plays sports. Therefore, the length of the watch needs to be adjusted at any time to keep the wrist comfortable whenever and wherever possible. A length of a steel watch strap is usually adjusted by increasing or reducing a quantity of balls of the watch strap, and both the increase and reduction of the quantity of the balls of the watch strap require a special-purpose tool to adjust tightness of wearing of the watch strap.

At present, a special-purpose tool used for separating a watch strap needs to be used when lengths of watch straps of most steel watch straps are adjusted by increasing or reducing quantities of ball of the watch straps. This is inconvenient for adjusting a watch strap length and wearing tightness during sports time whenever and wherever possible. In addition, a ball of a common steel watch strap has a relatively large width, that is, at least 3 mm, making it impossible to reach much smaller millimeter-level length fine adjustment by adjusting the length of the watch strap by changing a quantity of balls of the watch strap.

Methods in an existing solution of adjusting lengths of watch straps are all performing adjustment by increasing or reducing quantities of balls of the watch straps. It is very inconvenient to use the methods, and millimeter-level fine adjustment of a watch strap length cannot be implemented conveniently whenever and wherever possible without using any tool.

SUMMARY

Embodiments of this application provide a watch clasp capable of finely adjusting a watch strap length, to conveniently implement millimeter-level fine adjustment of a length of a watch strap whenever and wherever possible without using any tool to increase or reduce the length of the watch strap, thereby adjusting tightness of wearing of the watch strap whenever and wherever possible.

A first aspect of the embodiments of this application provides a watch clasp capable of finely adjusting a watch strap length, including: a watch clasp sliding holder 102, located on a back surface of a watch clasp case 101; a sliding stop module 104, fixing the watch clasp sliding holder 102 to the back surface of the watch clasp case 101 through engagement, where the sliding holder 102 can slide between the watch clasp case 101 and the sliding stop module 104; a stop spring bar 103, fixed to the watch clasp case 101, and an unlock module 105, fixed to the watch clasp case 101, where the unlock module 105 is engaged with the sliding stop module 104, and the stop spring bar 103 and the unlock module 105 are respectively located on two sides of the sliding stop module 104; and an extension latch assembly, where one end of the extension latch assembly 106 is fixed to the watch clasp case 101, and the other end of the extension latch assembly 106 is fixed to an elastic fine-adjusting assembly 107. The embodiments of this application provide a watch clasp capable of finely adjusting a watch strap length, to implement millimeter-level fine adjustment of a length of a watch strap whenever and wherever possible to increase or reduce the length of the watch strap, thereby adjusting tightness of wearing of the watch strap.

In a possible design, in a first implementation of the first aspect of the embodiments of this application, the elastic fine-adjusting assembly 107 includes: a supporter 108, a slider 109, a spring bar shaft 110, a drive block 111, a fixing spring bar 112, and a leaf spring 113. The leaf spring 113 is embedded into a connection port reserved on the drive block 111. The fixing spring bar 112 fixes the drive block 111 to the supporter 108. The fixing spring bar 112 fixes the slider 109 to the supporter 108. The spring bar shaft 110 is fixed to the slider 109. The spring bar shaft 110 is configured to connect to a watch strap. The embodiments of this application describe in detail the elastic fine-adjusting assembly, thereby increasing reliability and integrity of the embodiments of this application.

In a possible design, in a second implementation of the first aspect of the embodiments of this application, including: the sliding stop module 104 is engaged with the unlock module 105. By pressing two ends of the unlock module 105, a spring in the unlock module 105 drives a main toggle arm 114, and the main toggle arm 114 drives an auxiliary toggle arm 115 that is of the sliding stop module 104 and that is flexibly connected to the main toggle arm 114, so that two fixing poles 116 of the sliding stop module 104 move towards each other, to unlock the watch clasp sliding holder 102. The embodiments of this application describe in detail a connection manner of the sliding stop module and the unlock module, thereby increasing reliability and integrity of the embodiments of this application.

In a possible design, in a third implementation of the first aspect of the embodiments of this application, including: the stop spring bar 103 is fixed, by using an elastic device, to a fixing hole 1011 disposed on the watch clasp case 101. A size of the fixing hole 1011 is the same as a size of the elastic device. The stop spring bar 103 can adjust a length of the stop spring bar 103 by using the elastic device. The embodiments of this application describe in detail a fixing manner of the stop spring bar, thereby increasing reliability and integrity of the embodiments of this application.

In a possible design, in a fourth implementation of the first aspect of the embodiments of this application, including: the fixing spring bar 112 fixes the drive block 111 and the leaf spring 113 to the supporter 108. The slider 109 is flexibly connected to the supporter 108. The fixing spring bar 112, the drive block 111, and the leaf spring 113 are all located within a coverage range of the slider 109. The slider 109 can slide along a groove reserved on the supporter 108 the supporter. The slider 109 can adjust a sliding position by using the leaf spring 113. The embodiments of this application describe in detail a connection relationship between the components in the elastic fine-adjusting assembly, thereby increasing operability of the embodiments of this application.

In a possible design, in a fifth implementation of the first aspect of the embodiments of this application, including: the sliding stop module 104 is engaged with the watch clasp sliding holder 102. A fixing module of the sliding stop module 104 is provided with a notch 117. A position at which the watch clasp sliding holder 102 is engaged with the sliding stop module 104 is provided with a corresponding notch 117. The notch 117 is used to remove the connected sliding stop module 104. The embodiments of this application describe in detail a specific connection relationship between the sliding stop module and the watch clasp sliding holder, thereby making the embodiments of this application more complete.

In a possible design, in a sixth implementation of the first aspect of the embodiments of this application, including: the notch 117 is semicircular. The embodiments of this application limit the shape of the notch disposed on the watch clasp sliding holder, thereby increasing operability of the embodiments of this application.

In a possible design, in a seventh implementation of the first aspect of the embodiments of this application, the sliding stop module 104 includes an auxiliary toggle arm 115, a spring 118, and a sliding stop module enclosure 119. The auxiliary toggle arm 115 resets by using the spring 118. The fixing pole 116 is a part of the auxiliary toggle arm 115. The embodiments of this application describe in detail a specific structure of the components of the sliding stop module, thereby increasing operability of the embodiments of this application.

In a possible design, in an eighth implementation of the first aspect of the embodiments of this application, including: the fixing pole 116 and the auxiliary toggle arm 115 are detachably connected. The embodiments of this application limit a connection relationship between the fixing pole and the auxiliary toggle arm, thereby increasing operability of the embodiments of this application.

In a possible design, in a ninth implementation of the first aspect of the embodiments of this application, including: the unlock module 105 includes a main toggle arm 114, a spring 120, and an unlock module enclosure 121. The main toggle arm 114 resets by using the spring 120. The embodiments of this application describe in detail a specific structure of the components of the unlock module, thereby increasing operability of the embodiments of this application.

In a possible design, in a tenth implementation of the first aspect of the embodiments of this application, including: the extension latch assembly 106 includes a first extension fastening component 1061, a second extension fastening component 1062, and a fixing spring bar shaft 1063. A size of one end of the first extension fastening component 1061 is the same as a size of a groove reserved at one end of the second extension fastening component 1062, and the one end of the first extension fastening component 1061 and the one end of the second extension fastening component 1062 are connected by using a rotating shaft. The other end of the first extension fastening component 1061 is connected to an elastic fine-adjusting assembly 107. The other end of the second extension fastening component 1062 is connected to the watch clasp case 101. Rotation between the first extension fastening component 1061 and the second extension fastening component 1062 can form any angle. The fixing spring bar shaft 1063 is configured to fix the second extension fastening component 1062 to the watch clasp case 101. The embodiments of this application describe in detail a specific structure of the components of the extension latch assembly, thereby increasing operability of the embodiments of this application.

A second aspect of the embodiments of this application provides a watch strap, including the watch clasp according to any one of the first aspect or the first to the tenth implementation of the first aspect according to this application. The embodiments of this application provide the watch strap including the watch clasp, thereby increasing reliability of the embodiments of this application.

A third aspect of the embodiments of this application provides a watch, including the watch clasp according to any one of the first aspect or the first to the tenth implementation of the first aspect according to this application that is connected to a watch strap. The embodiments of this application provide the watch including the watch clasp, thereby increasing reliability of the embodiments of this application.

In the technical solution provided in the embodiments of this application, a watch clasp capable of finely adjusting a watch strap length is provided. The watch clasp capable of finely adjusting a watch strap length includes: a watch clasp sliding holder 102, located on a back surface of a watch clasp case 101; a sliding stop module 104, fixing the watch clasp sliding holder 102 to the back surface of the watch clasp case 101 through engagement, where the sliding holder 102 can slide between the watch clasp case 101 and the sliding stop module 104; a stop spring bar 103, fixed to the watch clasp case 101, and an unlock module 105, fixed to the watch clasp case 101, where the unlock module 105 is engaged with the sliding stop module 104, and the stop spring bar 103 and the unlock module 105 are respectively located on two sides of the sliding stop module 104; and an extension latch assembly, where one end of the extension latch assembly 106 is fixed to the watch clasp case 101, and the other end of the extension latch assembly 106 is fixed to an elastic fine-adjusting assembly 107. The embodiments of this application provide the watch clasp capable of finely adjusting a watch strap length, to conveniently implement millimeter-level fine adjustment of a length of a watch strap whenever and wherever possible without using any tool to increase or reduce the length of the watch strap, thereby adjusting tightness of wearing of the watch strap whenever and wherever possible.

DESCRIPTION OF EMBODIMENTS

Embodiments of this application provide a watch clasp capable of finely adjusting a watch strap length, to conveniently implement millimeter-level fine adjustment of a length of a watch strap whenever and wherever possible without using any tool to increase or reduce the length of the watch strap, thereby adjusting tightness of wearing of the watch strap whenever and wherever possible.

To make persons skilled in the art understand the solutions in this application better, the following describes the embodiments of this application with reference to the accompanying drawings in the embodiments of this application.

In the specification, claims, and accompanying drawings of this application, the terms "first", "second", "third", "fourth", and so on (if existent) are intended to distinguish between similar objects but do not necessarily indicate a specific order or sequence. It should be understood that the data termed in such a way are interchangeable in proper circumstances so that the embodiments of the present invention described herein can be implemented in other orders than the order illustrated or described herein. Moreover, the terms "include", "have" and any other variants mean to cover the non-exclusive inclusion, for example, a process, method, system, product, or device that includes a list of steps or units is not necessarily limited to those steps or units, but may include other steps or units not expressly listed or inherent to such a process, method, product, or device.

Figure 1:
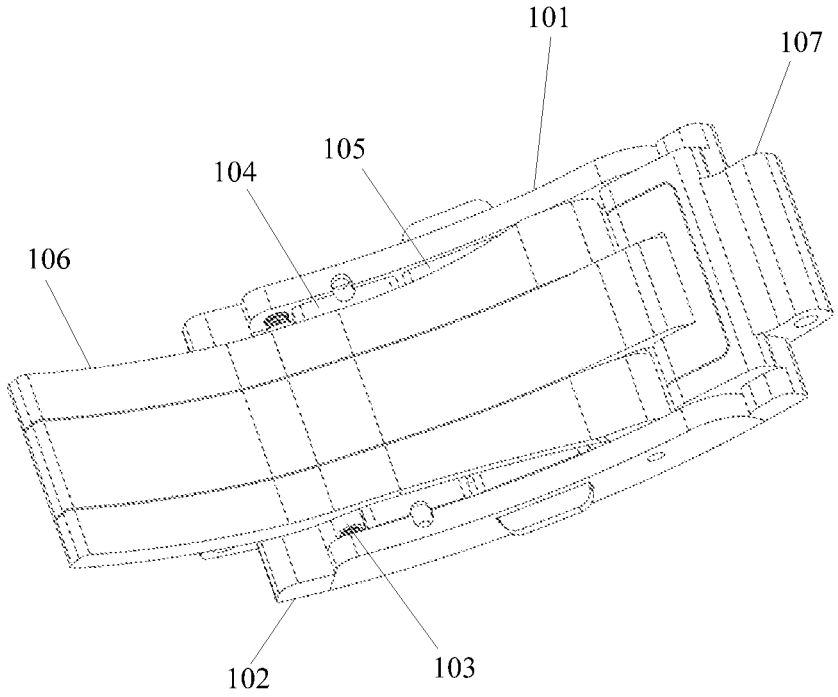
FIG. 1 is a schematic diagram of a back surface of a watch clasp in a closed state according to this application.
Figure 2:
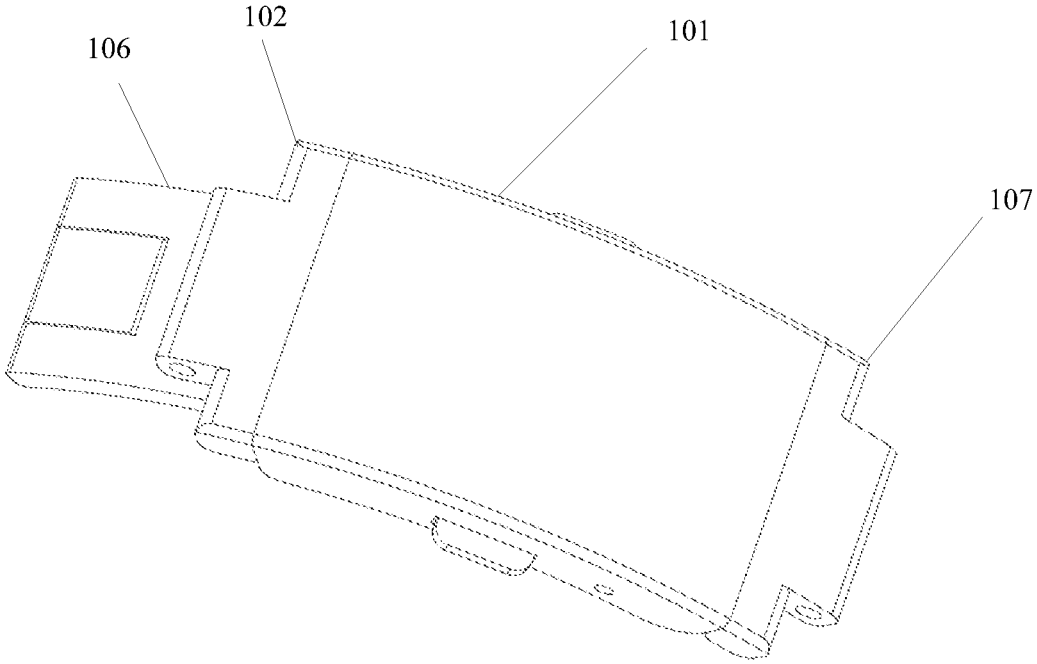
FIG. 2 is a schematic diagram of a front surface of a watch clasp in a closed state according to this application.

FIG. 1 is a schematic diagram of a back surface of a watch clasp in a closed state. FIG. 2 is a schematic diagram of a front surface of a watch clasp in a closed state according to this application. The following describes in detail a watch clasp with reference to the schematic diagrams.

As shown in FIG. 1 and FIG. 2, the watch clasp includes a watch clasp case 101, a watch clasp sliding holder 102, a stop spring bar 103, a sliding stop module 104, an unlock module 105, an extension latch assembly 106, and an elastic fine-adjusting assembly 107.

The watch clasp sliding holder 102 is located on a back surface of the watch clasp case 101.

The sliding stop module 104 fixes the watch clasp sliding holder 102 to the back surface of the watch clasp case 101 through engagement. The sliding holder 102 can slide between the watch clasp case 101 and the sliding stop module 104.

The stop spring bar 103 is fixed to the watch clasp case 101. The unlock module 105 is fixed to the watch clasp case 101, and the unlock module 105 is engaged with the sliding stop module 104. The stop spring bar 103 and the unlock module 105 are respectively located on two sides of the sliding stop module 104.

One end of the extension latch assembly 106 is fixed to the watch clasp case 101, and the other end of the extension latch assembly 106 is fixed to the elastic fine-adjusting assembly 107.

Figure 3:
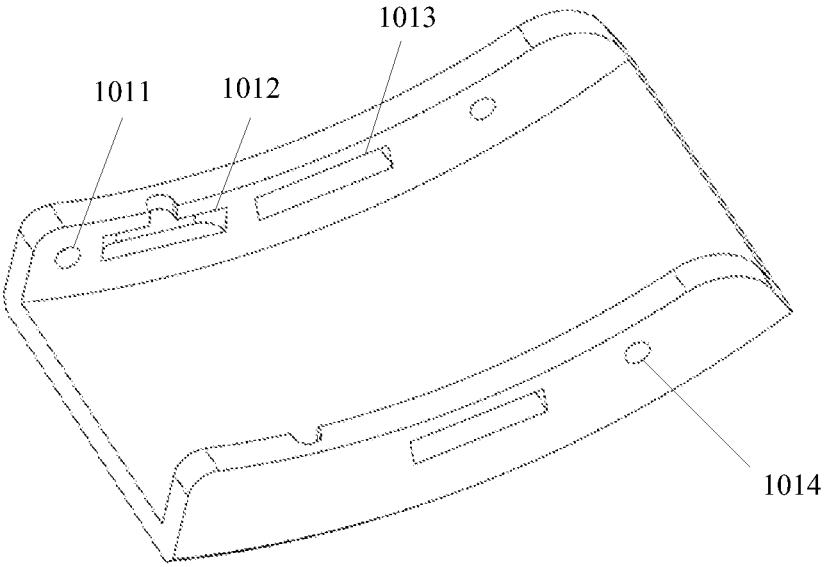
FIG. 3 is a schematic diagram of a watch clasp case of a watch clasp according to this application.

For example, the watch clasp case 101 is provided with fixing holes, used to fix another component of the watch clasp. As shown in FIG. 3, the watch strap case 101 is provided with a fixing hole 1011, a fixing hole 1012, a fixing hole 1013, and a fixing hole 1014 at positions shown in the figure. The fixing hole 1011 is used to fix the stop spring bar 103 to the watch clasp case 101, the fixing hole 1011 is a circular slot, and a size and a depth of the fixing hole 1011 are adapted to spring structures at two ends of the stop spring bar 103. The fixing hole 1012 is used to fix the sliding stop module 104 to the watch clasp case 101, and the fixing hole 1012 is a rectangle slot. In addition, a through slot is disposed on a side of the rectangle slot adjacent to the back surface of the watch clasp case 101, and the through slot is used to remove the fixed sliding stop module 104 by using a special-purpose tool. A size and a depth of the fixing hole 1012 are adapted to an auxiliary toggle arm 117 of the sliding stop module 104. Optionally, the through slot is semicircular. The fixing hole 1013 is used to fix the unlock module 105 to the watch clasp case 101, the fixing hole 1013 is a rectangle slot, and a size and a depth of the fixing hole 1013 are adapted to a main toggle arm 114 of the unlock module 105. The fixing hole 1014 is used to fix the elastic fine-adjusting assembly 107 to the watch clasp case 101, the fixing hole 1014 is a circular slot, and a size and a depth of the fixing hole 1014 are adapted to a structure of a fixing spring bar shaft 1063 of the extension latch assembly 106.

It can be understood that, the size, the shape and the depth of the fixing hole can be set based on an actual case. This is not specifically limited herein.

Figure 4:
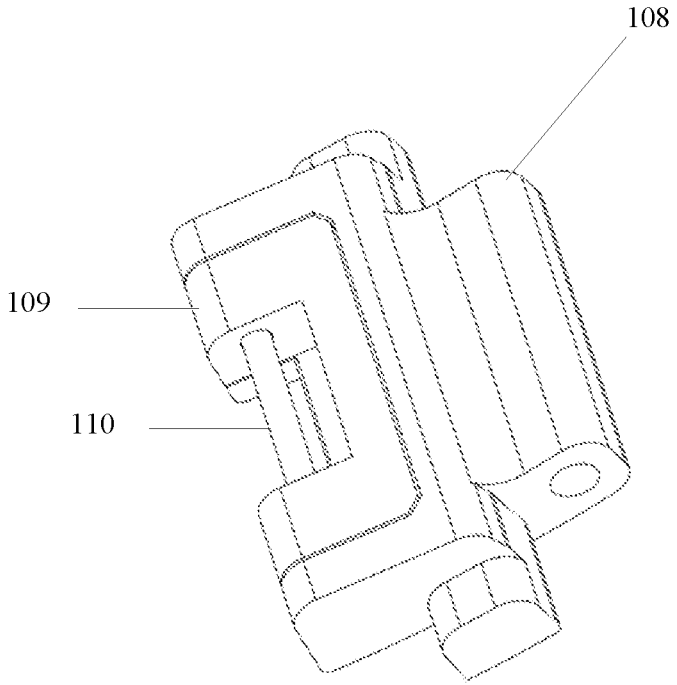
FIG. 4 is a schematic diagram of an elastic fine-adjusting assembly of a watch clasp according to this application.
Figure 5:
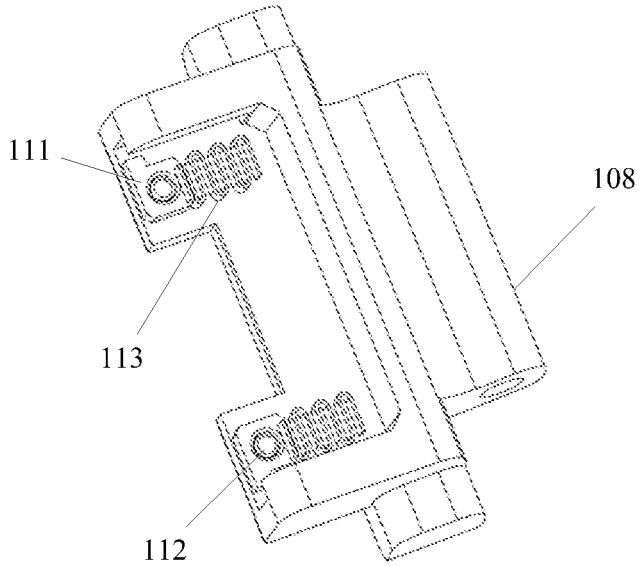
FIG. 5 is a schematic diagram of assembly of some components in an elastic fine-adjusting assembly according to this application.
Figure 6:
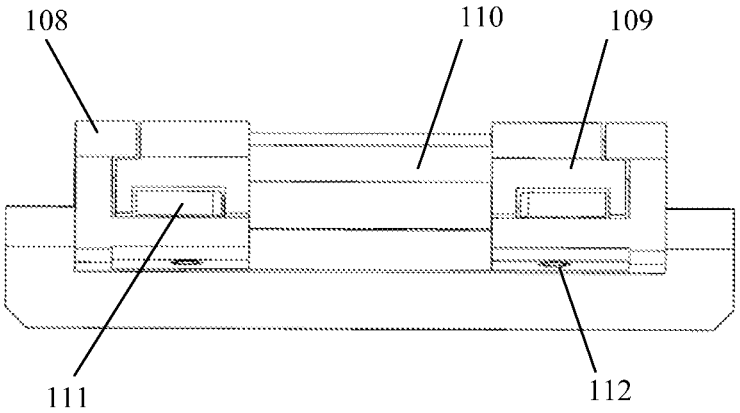
FIG. 6 is a side view of an elastic fine-adjusting assembly according to this application.

FIG. 4 is a schematic diagram of an elastic fine-adjusting assembly of a watch clasp according to this application. FIG. 5 is a schematic diagram of assembly of some components in an elastic fine-adjusting assembly according to this application. FIG. 6 is a side view of an elastic fine-adjusting assembly according to this application.

As shown in FIG. 4 and FIG. 5, the elastic fine-adjusting assembly 107 includes: a supporter 108, a slider 109, a spring bar shaft 110, a drive block 111, a fixing spring bar 112, and a leaf spring 113. With reference to FIG. 6, the supporter 108 is provided with a groove at a position at which the slider 109 is installed. The slider 109 slides by using the groove. A size and a depth of the groove may be set based on an actual case. This is not specifically limited herein. The drive block 111 is fixed right below of the slider 109, and the drive block 111 is flush with a side surface of the slider 109 and that of the supporter 108.

As shown in FIG. 5, the leaf spring 113 is embedded into a reserved connection port on the drive block 111, and the leaf spring 113 may be deformed along a sliding direction of the slider 109. That is, the slider 109 slides in a direction of the groove of the supporter 108 by using the deformation of the leaf spring 113. The fixing spring bar 112 fixes the drive block 111 to the supporter 108, so that the slider 109 is fixed into the groove of the supporter 108. The fixing spring bar 112 fixes the slider 109 to the supporter 108. The spring bar shaft 110 is fixed to the slider 109, and the spring bar shaft (110) is configured to connect to a watch strap.

For example, the fixing spring bar 112 fixes the drive block 111 and the leaf spring 113 to the supporter 108. The slider 109 is flexibly connected to the supporter 108, and the slider 109 slides in the groove disposed on the supporter 108. The fixing spring bar 112, the drive block 111, and the leaf spring 113 are all located within a coverage range of the slider 109. The slider 109 may slide along the groove reserved in the supporter 108 the supporter, and the slider 109 can adjust a sliding position by using the leaf spring 113.

Figure 7:
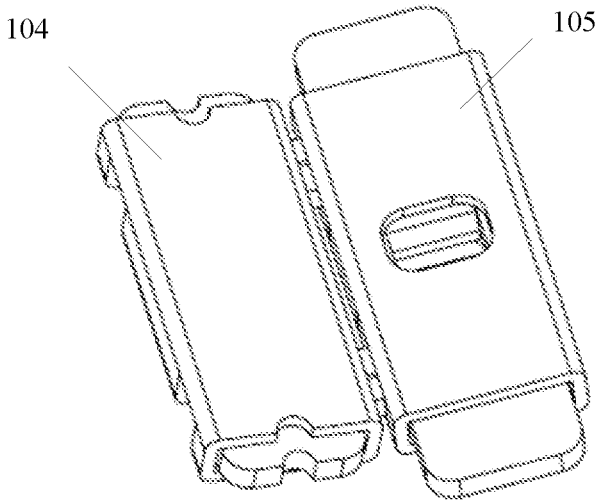
FIG. 7 is a schematic diagram of connection between a sliding stop module and an unlock module according to this application.
Figure 8:
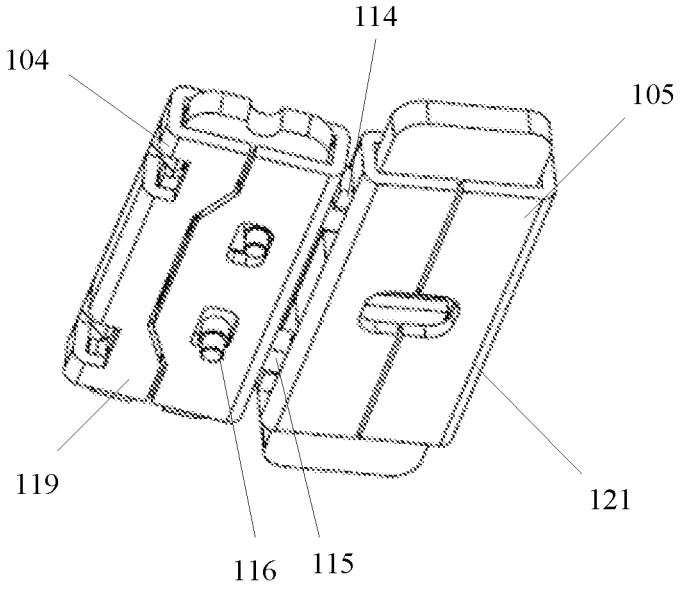
FIG. 8 is another schematic diagram of connection between a sliding stop module and an unlock module according to this application.
Figure 9:
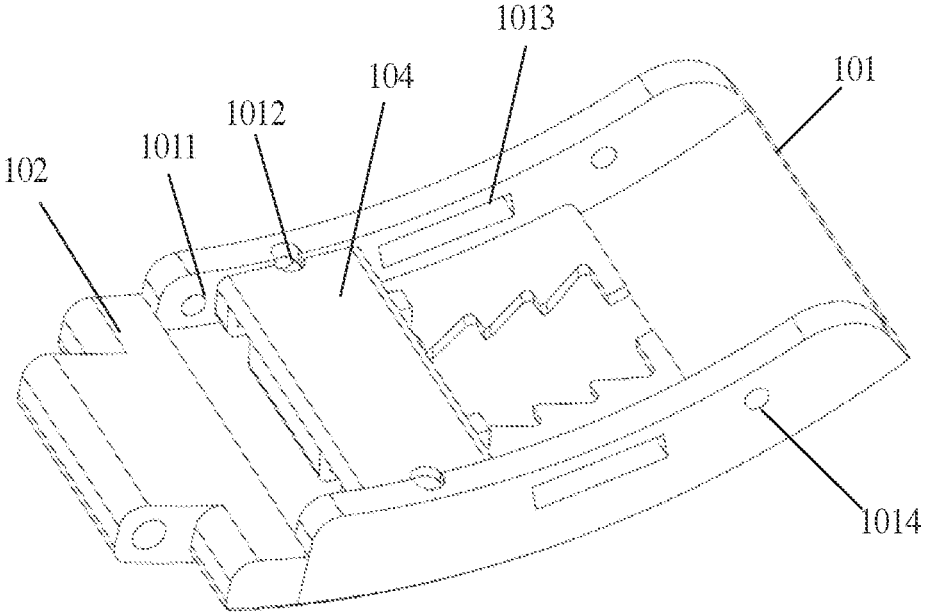
FIG. 9 is a schematic diagram of assembly of a sliding stop module according to this application.
Figure 10:
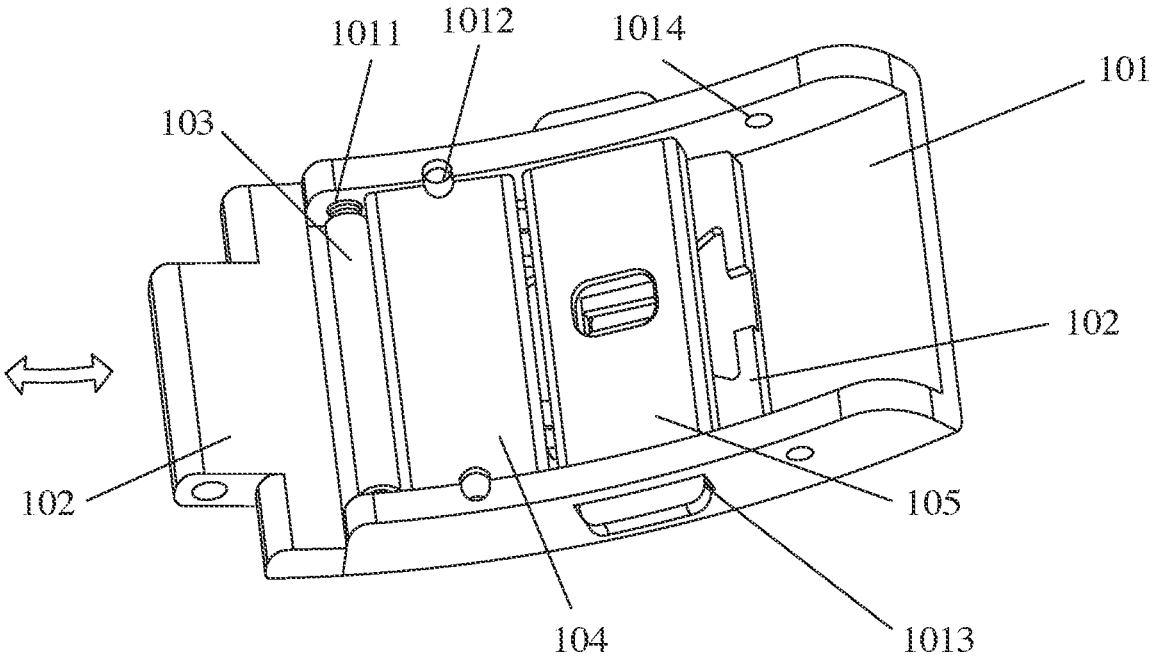
FIG. 10 is a schematic diagram of assembly of a sliding stop module and an unlock module according to this application.

FIG. 7 is a schematic diagram of connection between a sliding stop module and an unlock module according to this application. FIG. 8 is another schematic diagram of connection between a sliding stop module and an unlock module according to this application. FIG. 9 is a schematic diagram of assembly of a sliding stop module according to this application. FIG. 10 is a schematic diagram of assembly of a sliding stop module and an unlock module according to this application.

As shown in FIG. 7 and FIG. 8, the sliding stop module 104 is engaged with the unlock module 105. In a manner of pressing two ends of the unlock module 105, a spring in the unlock module 105 drives the main toggle arm 114, and the main toggle arm 114 drives the auxiliary toggle arm 115 that is of the sliding stop module 104 and that is flexibly connected to the main toggle arm 114, so that two fixing poles 116 of the sliding stop module 104 move towards each other, and the watch clasp sliding holder 102 can slide back and forth.

As shown in FIG. 9, when the sliding stop module 104 is engaged with the watch clasp case 101 by using the fixing hole 1012, the watch clasp sliding holder 102 is located between the sliding stop module 104 and the watch clasp case 101, and a sawtooth shape groove structure is disposed on a middle part of the watch clasp sliding holder 102. The fixing poles 116 of the sliding stop module 104 are away from each other. Each fixing pole 116 is engaged with the sawtooth shape groove structure. A position of the watch clasp sliding holder 102 is fixed.

Optionally, the sawtooth shape groove structure of the watch clasp sliding holder 102 is divided into five adjustable levels, and an adjustable length of each level is 2.08 millimeters. A quantity of the adjustable levels and the adjustable length of each adjustable level may further be set based on an actual case. A specific length is not limited herein.

As shown in FIG. 10, the sliding stop module 104 is engaged with the watch clasp case 101 by using the fixing hole 1012, the unlock module 105 is engaged with the watch clasp case 101 by using the fixing hole 1013, and the stop spring bar 103 is engaged with the watch clasp case 101 by using the fixing hole 1011. When the watch clasp sliding holder 102 is located between the sliding stop module 104 and the watch clasp case 101, the auxiliary toggle arm 115 of the sliding stop module 104 is located on an internal side of the main toggle arm 114 of the unlock module 105. When the unlock module is pressed, the two main toggle arms 114 move towards each other, to drive the auxiliary toggle arm 115 that is connected to the main toggle arm 114 to move closer, and the two fixing poles 116 that are connected to the auxiliary toggle arm 115 move towards each other, so that the two fixing poles 116 can slide in the sawtooth shape groove structure.

Optionally, the stop spring bar 103 is fixed, by using an elastic device, to the fixing hole 1011 disposed on the watch clasp case 101. The size of the fixing hole 1011 and a size of the elastic device are the same. The stop spring bar 103 can adjust a length of the stop spring bar 103 by using the elastic device. It can be understood that, a diameter size of the elastic device of the stop spring bar 103 is the same as a diameter size of the fixing hole 1011, so that the stop spring bar 103 can be firmly fixed to the watch clasp case 101.

It should be noted that, the sliding stop module 104 is engaged with the watch clasp sliding holder 102, a fixing module of the sliding stop module 104 is provided with a notch 117, and a position at which the watch clasp sliding holder 102 is engaged with the sliding stop module 104 is provided with a corresponding notch 117. The notch 117 is used to remove the sliding stop module 104 that is already engaged with the watch clasp case 101. Optionally, the notch 117 is semicircular, or may be further in another shape. This is not specifically limited herein.

Figure 11:
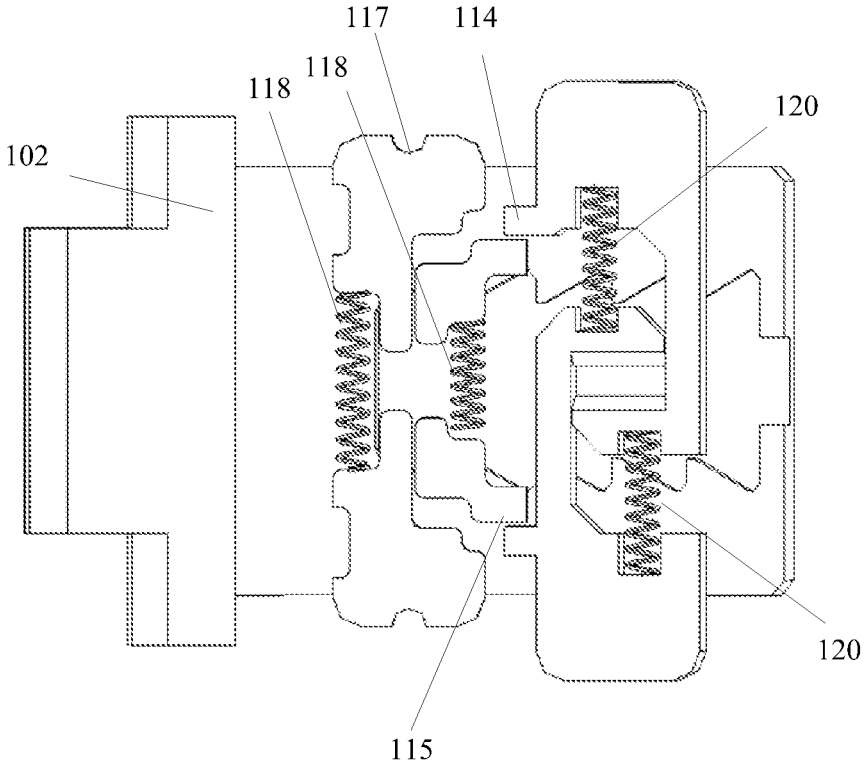
FIG. 11 is a schematic diagram of connection of some components of a sliding stop module and an unlock module on a watch clasp sliding holder according to this application.

Optionally, the sliding stop module 104 includes an auxiliary toggle arm 115, a spring 118, and a sliding stop module enclosure 119. As shown in FIG. 11, auxiliary toggle arm 115 resets by using the spring 118. The fixing pole 116 is a part of the auxiliary toggle arm 115.

Optionally, the unlock module 105 includes a main toggle arm 114, a spring 120, and an unlock module enclosure 121. The main toggle arm 114 resets by using the spring 120.

Optionally, the fixing pole 116 and the auxiliary toggle arm 115 are detachably connected. A specific detachable connection manner may be threaded connection or engagement, or may further be another detachable connection manner. This is not specifically limited herein.

For example, FIG. 11 is a schematic diagram of connection of some components that are of a sliding stop module and an unlock module and that are on a watch clasp sliding holder according to this application. As shown in FIG. 11, an auxiliary toggle arm 115 of the sliding stop module 104 is connected to a main toggle arm 114 of the unlock module 105 in a manner shown in the figure. The main toggle arm 114 of the unlock module 105 resets by using a spring 120 of the unlock module 105. When the main toggle arm 114 is pressed, two ends of a watch clasp case 101 are exposed, and the spring 120 is compressed. When the main toggle arm 114 is not pressed, the spring 120 extends, thereby driving the main toggle arm 114 to get back to a set initial position. When the auxiliary toggle arm 115 is driven by the main toggle arm 114, a spring 118 of the sliding stop module 104 is compressed. When the main toggle arm 114 is not pressed, the main toggle arm 114 resets, the auxiliary toggle arm 115 is not interfered with by external force anymore, and the spring 118 extends, thereby driving the auxiliary toggle arm 115 to get back to a set initial position and implementing a resetting function of the auxiliary toggle arm 115. When the main toggle arm 114 is pressed, two ends of a watch clasp case 101 are exposed, the auxiliary toggle arm 115 moves closer, and two fixing poles 116 (not shown in FIG. 11) that are located on the auxiliary toggle arm 115 move towards each other, so that the watch clasp sliding holder 102 releases a lock state, to implement a sliding function.

Figure 12:
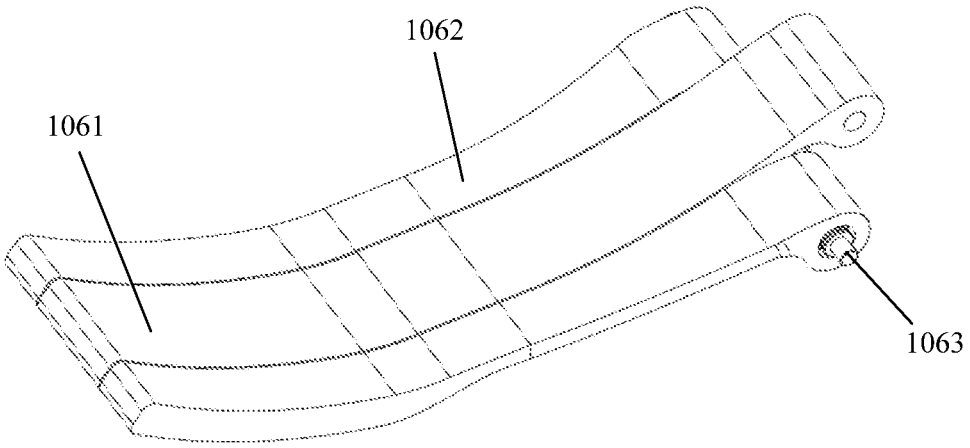
FIG. 12 is a schematic diagram of assembly of an extension latch assembly of a watch clasp according to this application.
Figure 13:
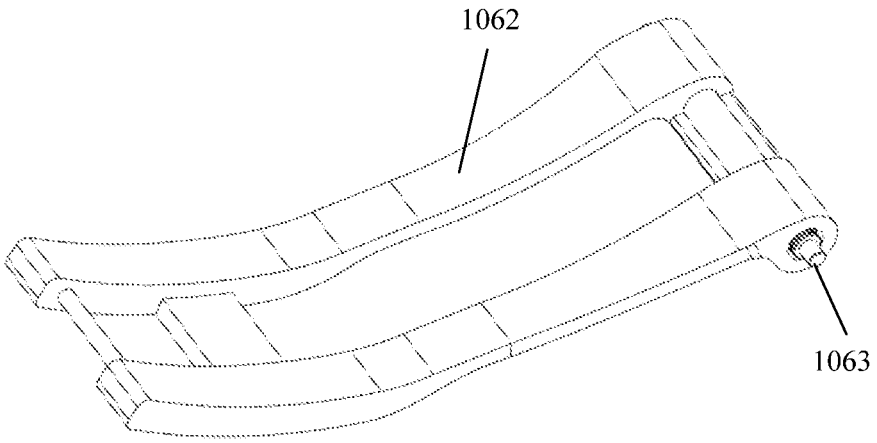
FIG. 13 is a schematic diagram of assembly of some components in an extension latch assembly of a watch clasp according to this application.

FIG. 12 is a schematic diagram of assembly of an extension latch assembly of a watch clasp according to this application. FIG. 13 is a schematic diagram of assembly of some components in an extension latch assembly of a watch clasp according to this application.

Optionally, the extension latch assembly 106 includes a first extension fastening component 1061, a second extension fastening component 1062, and a fixing spring bar shaft 1063. A size of one end of the first extension fastening component 1061 is the same as a size of a groove reserved at one end of the second extension fastening component 1062, and the one end of the first extension fastening component 1061 and the one end of the second extension fastening component 1062 are connected by using a rotating shaft The other end of the first extension fastening component 1061 is connected to an elastic fine-adjusting assembly 107, the other end of the second extension fastening component 1062 is connected to a watch clasp case 101, and rotation between the first extension fastening component

1061 and the second extension fastening component 1062 can form any angle. The fixing spring bar shaft 1063 is configured to fix the second extension fastening component 1062 to the watch clasp case 101.

For example, with reference to FIG. 11 and FIG. 12, a size of one end of the first extension fastening component 1061 of the extension latch assembly 106 is the same as the size of the groove reserved at one end of the second extension fastening component 1062, and the one end of the first extension fastening component 1061 and the one end of the second extension fastening component 1062 are connected by using the rotating shaft. The rotating shaft is shown in FIG. 13. The rotating shaft and the fixing spring bar shaft 1063 are respectively located at two ends of the second extension fastening component 1062. The extension latch assembly 106 fixes a segment of the second extension fastening component 1062 to the watch clasp case 101 by using the fixing spring bar shaft 1063.

The foregoing embodiments are merely intended for describing the technical solutions of this application, but not for limiting this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of this application.

What is claimed is:

1. A watch clasp for adjusting a watch strap length, comprising:

a watch clasp sliding holder located on a back surface of a watch clasp case;

a sliding stop module fixing the watch clasp sliding holder to the back surface of the watch clasp case through engagement, wherein the sliding holder slides between the watch clasp case and the sliding stop module;

a stop spring bar fixed to the watch clasp case;

an unlock module fixed to the watch clasp case, the unlock module including a main toggle arm that drives an auxiliary toggle arm of the sliding stop module, the auxiliary toggle arm being flexibly connected to the main toggle arm, and the stop spring bar and the unlock module being respectively located on two sides of the sliding stop module; and an extension latch assembly, wherein one end of the extension latch assembly is fixed to the watch clasp case, and another end of the extension latch assembly is fixed to an elastic fine-adjusting assembly.

2. The watch clasp according to claim 1, wherein by pressing two ends of the unlock module, a spring in the unlock module drives the main toggle arm, and the main toggle arm drives the auxiliary toggle arm so that two fixing poles of the sliding stop module move towards each other, to unlock the watch clasp sliding holder.

3. The watch clasp according to claim 2, wherein the sliding stop module is engaged with the watch clasp sliding holder, a fixing module of the sliding stop module is provided with a notch, a position at which the watch clasp sliding holder is engaged with the sliding stop module is provided with a corresponding notch, and the notch is used to remove the connected sliding stop module.

4. The watch clasp according to claim 3, wherein the notch is semicircular.

5. The watch clasp according to claim 2, wherein the sliding stop module comprises an auxiliary toggle arm, a spring, and a sliding stop module enclosure, the auxiliary toggle arm resets by using the spring, and the fixing pole is a part of the auxiliary toggle arm.

6. The watch clasp according to claim 2, wherein the unlock module comprises a main toggle arm, a spring, and an unlock module enclosure, and the main toggle arm resets by using the spring.

7. The watch clasp according to claim 1, wherein the stop spring bar is fixed, by using an elastic device, to a fixing hole disposed on the watch clasp case, a size of the fixing hole is the same as a size of the elastic device, and the stop spring bar adjusts a length of the stop spring bar by using the elastic device.

8. The watch clasp according to claim 1, wherein the extension latch assembly comprises a first extension fastening component, a second extension fastening component, and a fixing spring bar shaft, a size of one end of the first extension fastening component is the same as a size of a groove at one end of the second extension fastening component the one end of the first extension fastening component and the one end of the second extension fastening component are connected by using a rotating shaft, another end of the first extension fastening component is connected to the elastic fine-adjusting assembly, another end of the second extension fastening component is connected to the watch clasp case, rotation between the first extension fastening component and the second extension fastening component forms any angle, and the fixing spring bar shaft is configured to fix the second extension fastening component to the watch clasp case.

9. A watch clasp for adjusting a watch strap length, comprising:

a watch clasp sliding holder located on a back surface of a watch clasp case;

a sliding stop module fixing the watch clasp sliding holder to the back surface of the watch clasp case through engagement, wherein the sliding holder slides between the watch clasp case and the sliding stop module;

a stop spring bar fixed to the watch clasp case;

an unlock module fixed to the watch clasp case, wherein the unlock module is engaged with the sliding stop module, and the stop spring bar and the unlock module are respectively located on two sides of the sliding stop module; and an extension latch assembly, wherein one end of the extension latch assembly is fixed to the watch clasp case, and another end of the extension latch assembly is fixed to an elastic fine-adjusting assembly, wherein the elastic fine-adjusting assembly includes a supporter, a slider, a spring bar shaft, a drive block, a fixing spring bar, and a leaf spring, the leaf spring is embedded into a connection port on the drive block, and the fixing spring bar fixes the drive block to the supporter, and the fixing spring bar fixes the slider to the supporter, the spring bar shaft is fixed to the slider, and the spring bar shaft is configured to connect to a watch strap.

10. The watch clasp according to claim 9, wherein the fixing spring bar fixes the drive block and the leaf spring to the supporter, the slider is flexibly connected to the supporter, the fixing spring bar, the drive block, and the leaf spring are all covered by the slider, the slider slides along a groove on the supporter, and the slider adjusts a sliding position by using the leaf spring.

11. A watch strap, comprising a watch clasp that adjusts a length of the watch strap, the watch clasp including:

a watch clasp sliding holder, located on a back surface of a watch clasp case;

a sliding stop module, fixing the watch clasp sliding holder to the back surface of the watch clasp case through engagement, wherein the sliding holder slides between the watch clasp case and the sliding stop module;

a stop spring bar, fixed to the watch clasp case, and an unlock module, fixed to the watch clasp case, the unlock module including a main toggle arm that drives an auxiliary toggle arm of the sliding stop module, the auxiliary toggle arm being flexibly connected to the main toggle arm, and the stop spring bar and the unlock module being respectively located on two sides of the sliding stop module; and an extension latch assembly, wherein one end of the extension latch assembly is fixed to the watch clasp case, and another end of the extension latch assembly is fixed to an elastic fine-adjusting assembly.

12. A watch, comprising a watch strap and a watch clasp connected to the watch strap, the watch clasp adjusting a length of the watch strap, and the watch clasp including:

a watch clasp sliding holder, located on a back surface of a watch clasp case;

a sliding stop module, fixing the watch clasp sliding holder to the back surface of the watch clasp case through engagement, wherein the sliding holder slides between the watch clasp case and the sliding stop module;

a stop spring bar, fixed to the watch clasp case, and an unlock module, fixed to the watch clasp case, the unlock module including a main toggle arm that drives an auxiliary toggle arm of the sliding stop module, the auxiliary toggle arm being flexibly connected to the main toggle arm, and the stop spring bar and the unlock module being respectively located on two sides of the sliding stop module; and an extension latch assembly, wherein one end of the extension latch assembly is fixed to the watch clasp case, and another end of the extension latch assembly is fixed to an elastic fine-adjusting assembly.

* * * * *